US005106152A

United States Patent [19]

Ward, Sr. et al.

[11] Patent Number: 5,106,152

[45] Date of Patent: Apr. 21, 1992

[54] WHEELCHAIR PAK-RAK

[76] Inventors: Sammy W. Ward, Sr.; Cecilia Ward, both of 1203 N. Gibson, Farmington, N. Mex. 87401

[21] Appl. No.: 712,593

[22] Filed: Jun. 10, 1991

[51] Int. Cl.[5] ..... A47C 7/62

[52] U.S. Cl. ..... 297/192; 297/218

[58] Field of Search ..... 297/192, 188, 218, DIG. 4, 297/441; 280/288.4, 304.1, 304.5

[56] References Cited

U.S. PATENT DOCUMENTS

| | | | |
|---|---|---|---|
| 521,463 | 6/1894 | Smith-Fraser . | |
| 597,878 | 1/1898 | Crandall . | |
| 834,988 | 11/1906 | Mallory . | |
| 1,249,415 | 12/1917 | Kantor | 297/192 |
| 2,973,807 | 3/1961 | Close | 297/192 |
| 3,213,467 | 10/1965 | Hubbard . | |
| 4,577,878 | 3/1986 | Roy et al. . | |
| 5,015,033 | 5/1991 | Winters | 297/192 |

FOREIGN PATENT DOCUMENTS

| | | | |
|---|---|---|---|
| 31218 | 7/1960 | Finland | 297/218 |
| 1171746 | 1/1959 | France | 297/192 |

*Primary Examiner*—Laurie K. Cranmer
*Attorney, Agent, or Firm*—Robert W. Harris

[57] ABSTRACT

A device for carrying personal articles below the seat of a wheelchair, which may easily be attached to the underframe of the wheelchair, and is adjustable to fit the frames of wheelchairs of varying sizes. An array of cross-linked cloth strips is equipped with spaced velcro fasteners to allow ready attachment to the frames of wheelchairs of varying width. A vertical security barrier of cross-linked strips at the rear of the carrying platform prevents dropping of articles from the rear when the wheelchair is inclined upward as in ascending a wheelchair ramp.

10 Claims, 2 Drawing Sheets

WHEELCHAIR PAK-RAK

BACKGROUND OF THE INVENTION

The present invention concerns devices for allowing the user of a wheelchair to carry personal possessions along with him or her while moving in the wheelchair, and more particularly such a device for carrying such articles beneath the chair, so that the user of the wheelchair has hands free for the operations necessary in moving from place to place in the wheelchair.

Many thousands of people in our society engage in varied activities in wheelchairs, for which they are required to carry a number of possessions with them while moving from place to place. Students must carry books and notebooks. Shoppers must carry purses and shopping bags containing articles purchased. There is a need for an apparatus whereby the user of a wheelchair may carry such articles in a manner which leaves the user's hands free for rotating the wheels of the wheelchair, and for the other activities necessary for moving from place to place in the wheelchair. It is generally unsatisfactory to carry such articles in one's lap, since they may easily be dropped.

Since wheelchairs ordinarily do not come equipped with such carrying apparatus, there is also a need for such an apparatus which can be used with wheelchairs of varying sizes. Applicants' device satisfies this need by providing such a carrying device of the form of a platform of cross-linked cloth strips which can be mounted to the underframe of the wheelchair, which attaches to the frame by Velcro fasteners attached to the ends of cloth strips which make up the device, said Velcro fasteners having sufficient positions to accommodate a range of wheelchair frame sizes.

Although a platform located beneath the seat of the wheelchair can be used to carry personal articles, there is also a need for such a device to provide a means for carrying the articles securely when the wheelchair is moving in an upwardly inclined orientation, as when the user is going up a wheelchair ramp, or going up over a curb at the edge of a street, in which case the articles will naturally tend to slide and fall off the rear end of the platform, sometimes without the user of the wheelchair even being aware of the loss. Even when the user is aware that objects have fallen, there is the inconvenience and delay of having to turn around and go back to retrieve them.

Applicants' device deals effectively with this problem by providing at least one cloth strap at the rear of the support platform which is located above but parallel to the support platform, just slightly above the platform, which acts to stop personal objects from sliding off the rear of the platform.

SUMMARY OF THE INVENTION

The invention is a carrying device for carrying articles beneath a wheelchair, comprising in combination an array of cross-linked cloth straps for attachment to the underframe of a wheelchair; and attachment means for attachment of said array to the underframes of wheelchairs of varying width, which attachment means is, in the preferred embodiment, a plurality of Velcro fasteners on those of said straps which extend to the sides of said wheelchair; said array further comprising securing means for preventing articles carried on said array from being dislodged and falling from the rear of said array when the forward end of said wheelchair is inclined upward, as when proceeding up a wheelchair ramp or going upward over a curb, said securing means in the preferred embodiment comprising at least one of said straps for attachment to the rear of the underframe of said wheelchair at an elevation slightly above the elevation of the main portion of said array.

The purposes of Applicants' invention include the provision of a carrying apparatus allowing the user of a wheelchair to carry articles beneath the seat of the wheelchair, having advantages which include, but are not necessarily limited to, providing such an apparatus which, in the preferred embodiment: is easy for the user to quickly attach to or detach from the wheelchair; is inexpensive to manufacture; is light in weight, using a minimum of necessary material; is adjustable to fit wheelchairs of varying frame sizes; is flexible to accommodate articles of various shapes; will fold along with the wheelchair when it is folded; can be used to carry a variety of personal articles such as books and notebooks of students, purses, coats and shopping bags; and provides means to carry such articles securely so that they will not slip off the back of the support when the wheelchair is inclined upward as in jumping a curb.

DESCRIPTION OF THE PREFERRED EMBODIMENT

Figure 1:
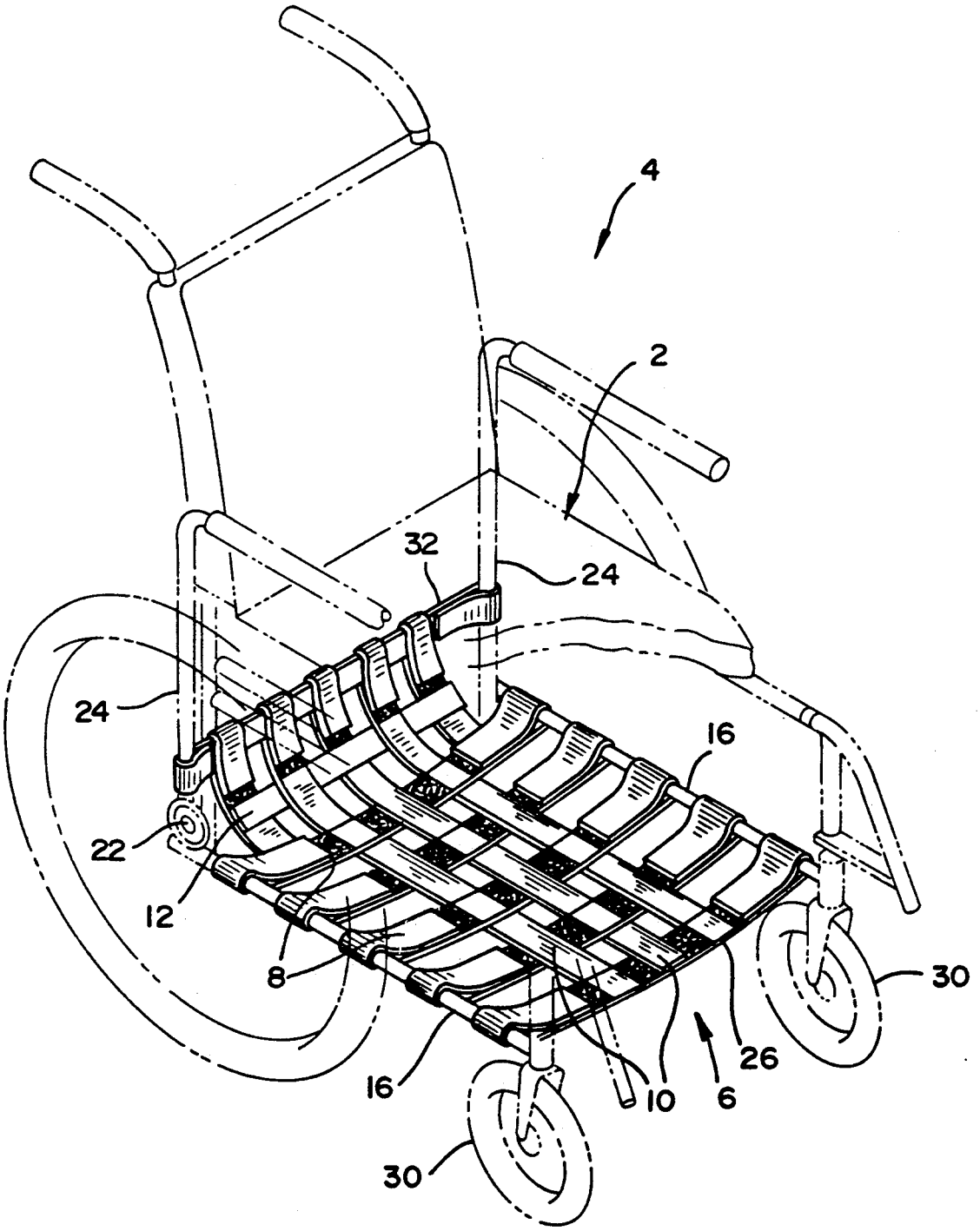
FIG. 1 is a perspective view of the device attached to a wheelchair.
Figure 2:
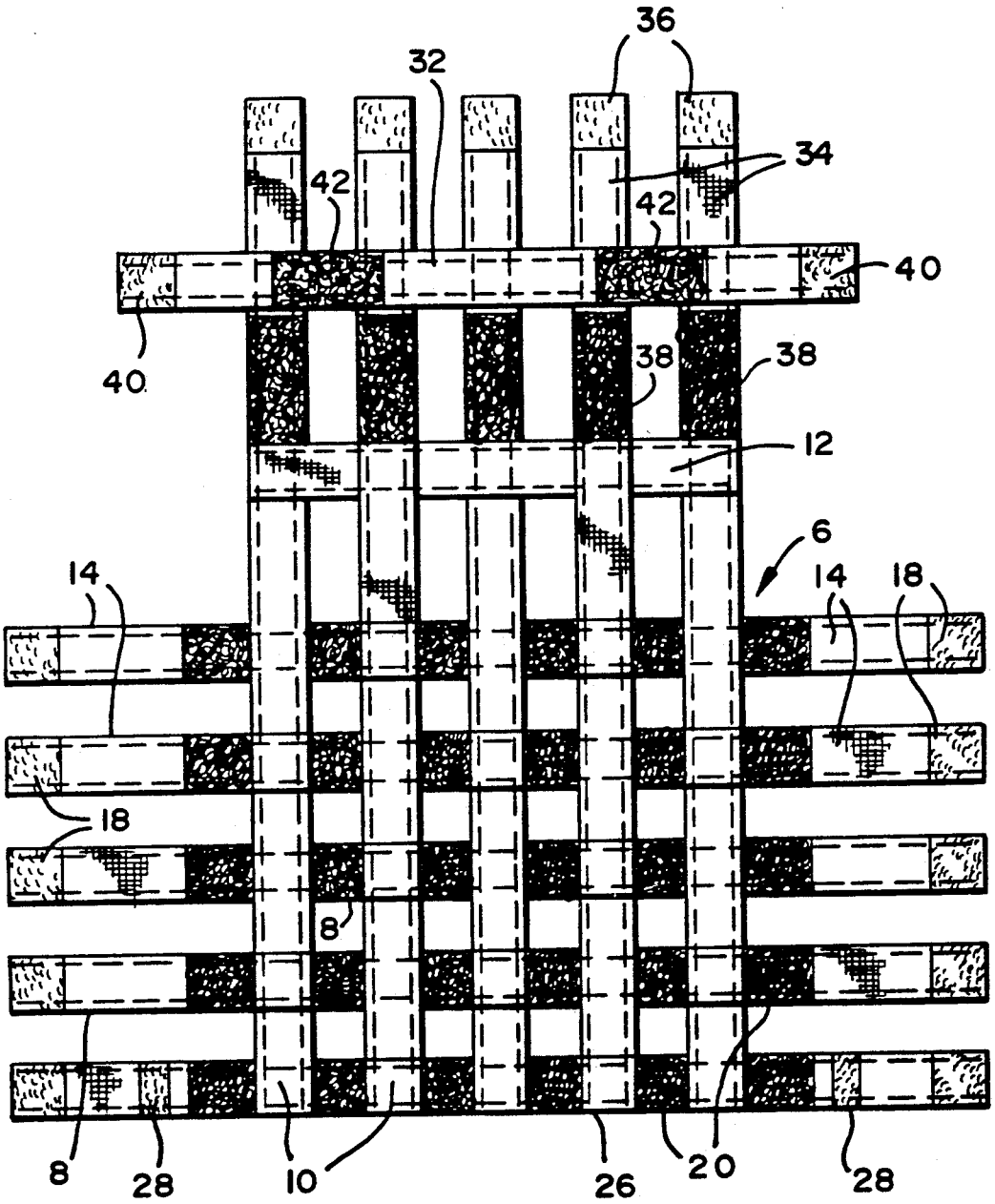
FIG. 2 is a plan view of the device.

Referring now to the drawings, in which like reference numbers denote like or corresponding elements, the device of the present invention provides a means for supporting articles beneath the seat 2 of the wheelchair 4. Said support means is an array 6 of cross-linked cloth strips, formed by a set of parallel strips 8, which are to extend from side to side beneath seat 2, and another set of parallel strips 10, at right angles to and interlocking with strips 8, said strips 10 extending from the front to the rear of wheelchair 4. For strength of support for the articles to be carried, the strips 8 and strips 10 are sewed, glued or otherwise attached to one another in any convenient, secure fashion, at each of the points at which one of strips 8 crosses one of the strips 10. The use of cloth strips for strips 8 and 10 offers the advantage of flexibility of the support means provided by array 6, which facilitates using the invention to carry articles of varied shapes on array 6, since array 6 can to some extent deform to accommodate the shapes of the articles carried. Seat belt strip material is used for the strips 8 and strips 10.

The invention also includes attachment means, for attaching the array 6 to the frame of wheelchair 4, for frames of varying sizes. Each of the strips 8 except the strip 12 has at each end thereof an end section 14, and each of said end sections 14 extends beyond the corresponding outermost one of the strips 10. For purposes of attachment of array 6 to the horizontal frame members 16 located at the sides of the base of wheelchair 4, and in order to allow such attachment to be made for a range of sizes of wheelchair 4, i.e. for a range of spacing distances between the two frame members 16, Velcro attachments are provided on strips 8, in a manner conducive to accommodating wheelchairs of various sizes. A velcro hook section 18 is attached near the outer end of each end section 14. Attached at various spaced locations along each of the strips 8, at locations between the crossing points of the strips 10, are a series of Velcro loop sections 20, to each of which the velcro hook section 18 at the end of the corresponding end section 14 may be attached. The lengths of the end sections 14, and the number of the Velcro loop sections 20, allow the end sections 14 to be looped around the frame members 16, and allow the velcro hook section 18 at the end of each end section 14 to be attached to an appropriate Velcro loop sections 20, so that array 6 is secured to frame members 16 of wheelchair 4. By suitable choice of the length of end sections 14, and the number of Velcro loop sections 20 spaced along strips 8, the apparatus may be made to be usable with wheelchairs having any desired range of spacing between frame members 16. The strip 12 at the rear of array 6 is not equipped with the Velcro fasteners, because of the proximity of frame joint 22 of the frame of wheelchair 4, at which frame members 16 join vertical frame members 24 on each side of wheelchair 4. The forwardmost strip 26 of the strips 8 has an additional velcro hook section 28 located a small distance inside each of the corresponding velcro hook sections 18. Because of the proximity of the forward wheel 30 of wheelchair 4, this extra velcro hook section 28 allows some latitude for fastening of strip 26 to frame members 16, which may be necessary depending upon the size of forward wheel 30.

The invention also provides securing means for preventing carried articles from sliding off of the rear of array 6 when wheelchair 4 is inclined with the front end thereof above the rear end thereof, as when the user is moving up a wheelchair ramp, or going up over a curb. The principal such securing means is provided by the combination of a strip 32, of the same material as the strips 8 and the strips 10, which in the operational configuration of the device is oriented with its plane vertical and with its longitudinal axis disposed horizontally a short distance above the plane of array 6, and end sections 34 of the strips 10, which are in the operational configuration oriented vertically at the back of wheelchair 4, extending up to and around strip 32, to which they are secured by means of velcro hook sections 36 attached to the outer end of each of end sections 34, and velcro loop sections 38 attached to each of end sections 34 at a suitable position further from the end of each of end sections 34 than the locations of velcro hook sections 36, with the spacing between velcro hook sections 36 and velcro loop sections 38 being sufficient to allow the endmost portion of each of end sections 34 to be looped around strip 32, to which each of the end sections 34 is secured by attachment of its velcro hook section 36 to its velcro loop section 38. The strip 32 has Velcro hook sections 40 at the ends thereof, and Velcro loop sections 42 located inside the positions of loop sections 42, so that strip 32 may be attached to the vertical frame members 24 of wheelchair 4. The loop sections 42 have sufficient length to allow strip 32 to be attached to the frames of wheelchairs of varying frame width, for the same range of frame widths as may be accommodated by the above-described Velcro fasteners for strips 8. In this manner the strip 32 and end sections 34 form a barrier at the rear of and above the plane of array 6, which acts to prevent carried articles from sliding off the rear of array 6, particularly when wheelchair 4 is inclined at an upward elevation. Another feature of the invention which acts to some extent to secure carried articles against falling from the platform formed by array 6, is simply the fact that strips 8 and 10 are made of cloth, rather than being formed of a rigid material, so that the flexibility of strips 8 and strips 10 allows the central portion of array 6 to deform downward under the weight of the carried articles. Thus the outer edges of array 6 will be at a higher elevation than the central portion, and will therefore form somewhat of a barrier against loss of articles, not only to the rear, but also in the other directions.

Those familiar with the art will appreciate that the invention may be employed in configurations other than the specific forms disclosed herein, without departing from the essential substance thereof.

For example, and not by way of limitation, Velcro fasteners need not be used for making the fastening connections described above. Other kinds of fasteners could be used instead, such as button-type snap fasteners. Similarly, although seat belt material is used to form the strips 8 and strips 10 in the preferred embodiment, numerous other kinds of cloth or flexible plastic materials of suitable strength could be used instead.

Although the preferred embodiment employs an array 6 of uniformly spaced strips 8 and strips 10, it should be recognized that the invention may be fabricated in forms which depart from such uniform strip spacing, in order to allow the invention to be used with particular wheelchairs. For example, in some older model wheelchairs made prior to about 1980, the frame members 16 have a curved portion near the front of the wheelchair 4, and it may be necessary or convenient to vary the spacing of the strips 8 at this portion of the frame members 16.

The scope of the invention is defined by the following claims, including also all subject matter encompassed by the doctrine of equivalents as applicable to the claims.

We claim:

1. Device for carrying articles beneath the seat of any of a plurality of wheelchairs each having a frame, for said wheelchairs having a range of sizes of said frames, comprising:

(a) flexible support means, for supporting said articles beneath said seat, comprising an array of cross-linked flexible strips formed by a first set of at least substantially parallel and at least substantially horizontally inclined flexible strips extending across the frame of said wheelchair from one side of said frame to the other side of said frame, beneath the seat of said wheelchair, and a second set of at least substantially parallel and at least substantially horizontally inclined flexible strips, at substantially the same elevation as said first set flexible strips, extending from the front to the rear of said frame of said wheelchair, wherein each of said strips of said first set of flexible strips is attached to each of said strips of said second set of flexible strips at each point of crossing of said strip from said second set of flexible strips;

(b) attachment means, connected to said support means, for attaching said support means to said frame of said wheelchair beneath said seat for a range of sizes of said wheelchair frame; and (c) securing means, connected to said support means, for preventing said articles from sliding off of said support mans when said wheelchair is moving up an incline.

2. The device of claim 1 wherein each of said flexible strips is formed of cloth.

3. The device of claim 2 wherein said array of cloth strips has lateral dimensions at least substantially equal to the lateral dimensions of said seat of said wheelchair, and wherein the center of said array is located at least substantially beneath the center of said seat of said wheelchair.

4. The device of any of claims 1, 2, or 3, wherein said attachment means comprises a first fastener means near each end of each of at least most of said strips of said first set of strips, and an array of second fastener means spaced at intervals along each of said strips having said first fastener means near each end thereof, said first fastener means and said second fastener means being means to securely fasten to one another and to also allow unfastening from one another, and wherein the length of the said array of said second fastener means is sufficient to allow said attachment means to be used to attach said support means to the frame of said wheelchair for the expected range of sizes of said frames of said wheelchairs.

5. The device of claim 6 wherein each of first fastener means is a Velcro hook section, and wherein each of said second fastener means is a velcro loop section.

6. The device of any of claims 1, 2, and 3 wherein said securing means comprises deformation means to allow said support means to deform under the weight of said articles, so that the outer edges of said support means are at a higher elevation than the center of said support means.

7. The device of claim 6 wherein said deformation means comprises said flexibility of said support means.

8. The device of claim 6 wherein said securing means further comprises a short vertical barrier at the rear of said support means.

9. The device of claim 8 wherein said barrier comprises a cross-linked vertical configuration, of cloth strips.

10. The device of claims 1, 2, or 3, wherein said strips of said first set of strips and said second set of strips are at least substantially uniformly spaced.

* * * * *